US006494505B2

(12) United States Patent
Kobayashi et al.

(10) Patent No.: US 6,494,505 B2
(45) Date of Patent: Dec. 17, 2002

(54) AUTOMOTIVE DOOR LOCK ASSEMBLY

(75) Inventors: Fumio Kobayashi, Kanagawa (JP); Ryoji Shimura, Yokohama (JP)

(73) Assignee: Ohi Seisakusho Co., Ltd., Kanagawa (JP)

( * ) Notice: Subject to any disclaimer, the term of this patent is extended or adjusted under 35 U.S.C. 154(b) by 0 days.

(21) Appl. No.: 09/983,910

(22) Filed: Oct. 26, 2001

(65) Prior Publication Data

US 2002/0050721 A1 May 2, 2002

(30) Foreign Application Priority Data

Oct. 30, 2000 (JP) ..... 2000-330891

(51) Int. Cl.[7] ..... E05C 3/06
(52) U.S. Cl. ..... 292/201; 292/216
(58) Field of Search ..... 292/216, 201, 292/DIG. 23; 70/264

(56) References Cited

U.S. PATENT DOCUMENTS 3,858,919 A * 1/1975 Kleefeld ..... 292/216
5,466,021 A * 11/1995 Ishihara ..... 292/201
5,802,894 A * 9/1998 Jahrsetz ..... 70/264
5,992,194 A * 11/1999 Baukholt ..... 70/279
6,079,237 A * 6/2000 Hochart ..... 70/278.6
6,168,216 B1 * 1/2001 Nakajima ..... 292/201
6,189,940 B1 * 2/2001 Hayakawa ..... 292/216
6,286,878 B1 * 9/2001 Hochart ..... 292/216

FOREIGN PATENT DOCUMENTS

JP 3-272788 * 3/1991 ..... E05B/61/00

* cited by examiner

*Primary Examiner*—Gary Estremsky
(74) *Attorney, Agent, or Firm*—Sughrue Mion, PLLC

(57) ABSTRACT

An automotive door lock assembly comprises a lock/unlock mechanism and an electric actuator which actuates the lock/unlock mechanism. At an initial stage of a door unlocking operation of the electric actuator, a passive lever is shifted from an engaged position where a lock/unlock lever and a sub-lever are engaged to move together to a disengaged position where the engagement between the lock/unlock lever and the sub-lever is canceled. When the passive lever is shifted to the disengaged position, the sub-lever can be quickly shifted to the unlock position by the force of a spring prior to shifting of the lock/unlock lever to the unlock position from the lock position by the electric actuator. With this arrangement, the electric actuator can be made of a relatively low power electric motor, and the lock/unlock mechanism can be quickly shifted to a door unlocking condition upon manipulation of a door handle.

8 Claims, 11 Drawing Sheets

AUTOMOTIVE DOOR LOCK ASSEMBLY

BACKGROUND OF THE INVENTION

1. Field of the Invention

The present invention relates in general to door lock assemblies and more particularly to automotive door lock assemblies of a power type, which comprises a door lock device and an electric actuator for actuating the door lock device.

2. Description of Related Art

Hitherto, various types of door lock assemblies have been put into practical use particularly in the field of wheeled motor vehicles. Some of them are of a type which comprises a lock/unlock mechanism that can switch between lock and unlock conditions, and an electric actuator that forces the lock/unlock mechanism to switch between the lock and unlock conditions with an electric force. That is, in the lock condition of the mechanism, an outside door handle is inoperative and thus the door can not be opened even if the door handle is manipulated, while, in the unlock condition of the mechanism, the outside door handle is operative and thus manipulation of the handle can induce opening of the door.

Recently, some of the door lock assemblies have a so-called "keyless entry system" incorporated therewith. In this system, a wireless control is used for operating the electric actuator to force the lock/unlock mechanism to switch between the lock and unlock conditions. One of such entry systems is of a type which comprises a portable signal transmitter carried by an operator (viz., driver), a signal receiver installed in the vehicle and a control unit installed in the vehicle for controlling the electric actuator in accordance with a code signal received by the signal receiver. That is, when the operator (viz., driver) carrying the transmitter approaches the vehicle door and manipulates the outside door handle of the vehicle, the signal receiver detects the code signal from the transmitter and the control unit issues an instruction signal to the electric actuator to assist the door opening manipulation of the driver. More specifically, upon sensing the code signal, the electric actuator is energized to force the lock/unlock mechanism to switch from the lock condition to the unlock condition. Thus, thereafter, the door can be opened by a continued manipulation of the door handle by the operator.

SUMMARY OF THE INVENTION

In the above-mentioned door lock assembly incorporated with the keyless entry system, speedy switching from the lock condition to the unlock condition is inevitably needed by the lock/unlock mechanism because the manipulation of the outside handle by the operator (viz., driver) is usually made right after the signal receiver receives the code signal from the transmitter. For achieving the quick switching, the known door lock assembly uses a high power electric actuator. However, as is known, usage of such high power actuator tends to bring about increase in cost of the door lock assembly as well as increase in size of the same.

It is therefore an object of the present invention to provide an automotive door lock assembly of a power type, which is free of the above-mentioned drawbacks.

That is, according to the present invention, there is provided an automotive door lock assembly of a power type, which can quickly switch the lock/unlock mechanism from the lock condition to the unlock condition without using a high power electric actuator.

According to a first aspect of the present invention, there is provided an automotive door lock assembly which comprises a lock unlock mechanism including a lock/unlock lever and a sub-lever, the lock/unlock mechanism being able to switch between a lock condition wherein both the lock/unlock lever and sub-lever assume respective lock positions to induce a locked condition of the door and an unlock condition wherein both the lock/unlock lever and sub-lever assume respective unlock positions to induce an unlocked condition of the door; an electric actuator which forces the lock/unlock mechanism to switch between the lock and unlock conditions with an electric force; and a structure including a passive lever and a biasing means which are incorporated with the door lock assembly, the passive lever being actuated by the electric actuator and shifted, at an initial stage of the operation of the electric actuator for shifting the lock/unlock mechanism to the unlock condition, from an engaged position where the lock/unlock lever and the sub-lever are engaged to move together to a disengaged position where the engagement between the lock/unlock lever and the sub-lever is canceled, wherein when the passive lever is shifted to the disengaged position, the sub-lever is shifted to the unlock position by the biasing means prior to shifting of the lock/unlock lever to the unlock position from the lock position by the electric actuator.

According to a second aspect of the present invention, there is provided an automotive door lock assembly which comprises a lock/unlock mechanism including a lock/unlock lever and a sub-lever which are each movable between lock and unlock positions, the lock/unlock mechanism being able to switch between a lock condition wherein both the lock/unlock lever and sub-lever assume respective lock positions to induce a locked condition of the door, an unlock condition wherein both the lock/unlock lever and sub-lever assume respective unlock positions to induce an unlocked condition of the door and a temporary unlocked condition wherein the lock/unlock lever assumes the lock position or a position between the lock and unlock positions and the sub-lever assumes the unlock position to induce an unlocked condition of the door; a passive lever movably connected to one of the lock/unlock lever and the sub-lever, the passive lever being movable between an engaged position where the passive lever engages with a stopper portion provided on the other of the lock/unlock lever and the sub-lever thereby to engage the lock/unlock lever with the sub-lever and a disengaged position where the passive lever disengages from the stopper portion thereby to permit the lock/unlock mechanism to switch from the lock condition to the temporary unlocked condition; biasing means which biases the sub-lever toward the unlock position with respect to the lock/unlock lever; an electric actuator; an operation lever which is moved by the electric actuator between a lock position to induce the lock condition of the lock/unlock mechanism and an unlock position to induce the unlock condition of the lock/unlock mechanism; and a cancel lever moved by the electric actuator, the cancel lever being capable of shifting the passive lever to the disengaged position from the engaged position prior to the movement of the operation lever to the unlock position from the lock position.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENT

In the following, the present invention will be described in detail with reference to the accompanying drawings. For ease of understanding, various directional terms, such as, right, left, upper, lower, clockwise and the like, are used in the description. However, these terms are to be understood with respect to only a drawing or drawings on which a corresponding part or portion is illustrated.

Figure 8:
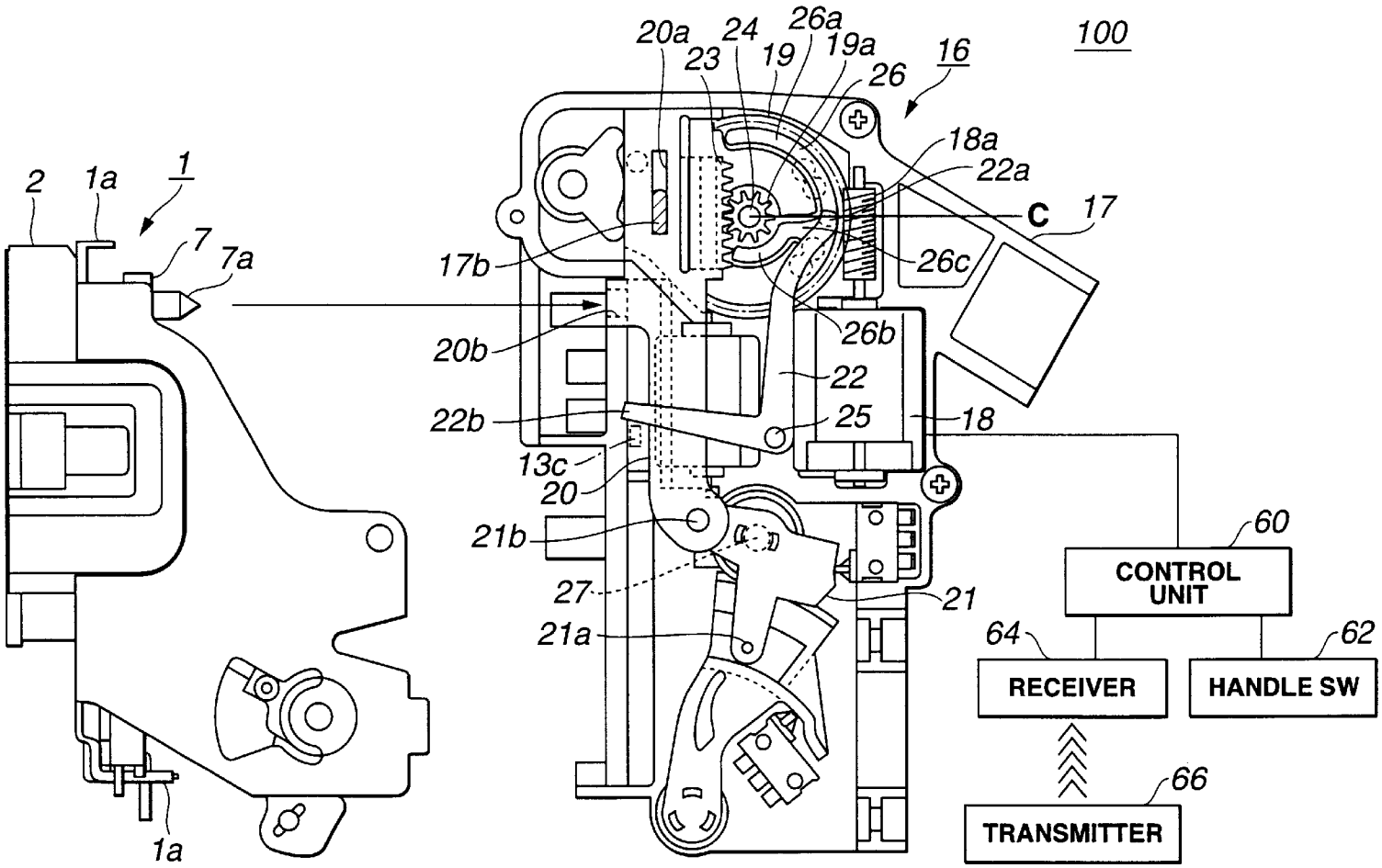
FIG. 8 is a view of the door lock device and an electric actuator, which are shown uncoupled.
Figure 11:
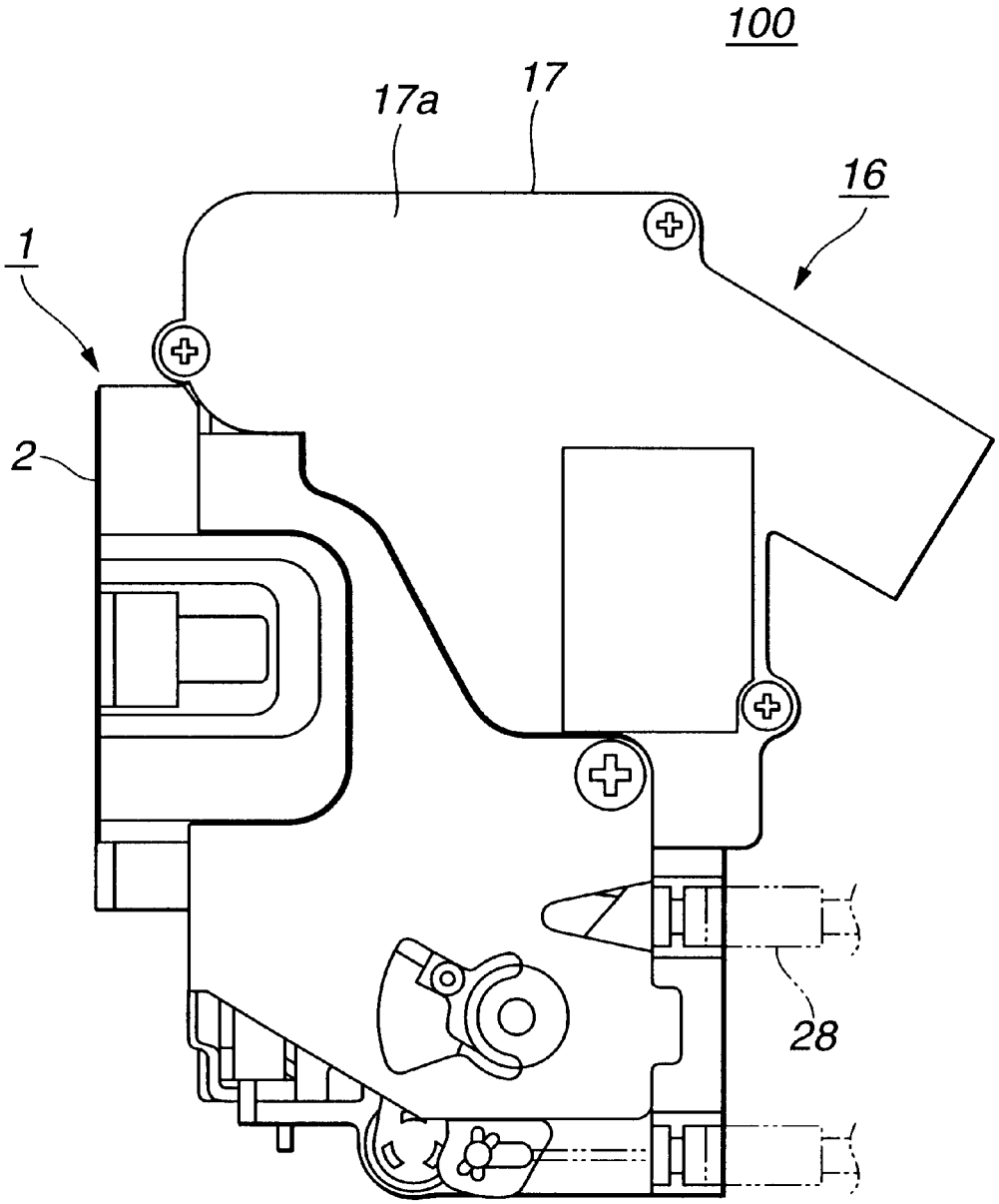
FIG. 11 is a side view of the automotive door lock assembly in an assembled condition.

Referring to FIGS. 8 and 11, there is shown an entire construction of the automotive door lock assembly according to the present invention, which is generally denoted by numeral 100.

As is seen from these drawings, the door lock assembly 100 of the invention generally comprises a door lock device 1 and an electric actuator 16, which are combined in such a manner as will be described hereinafter.

Figure 1:
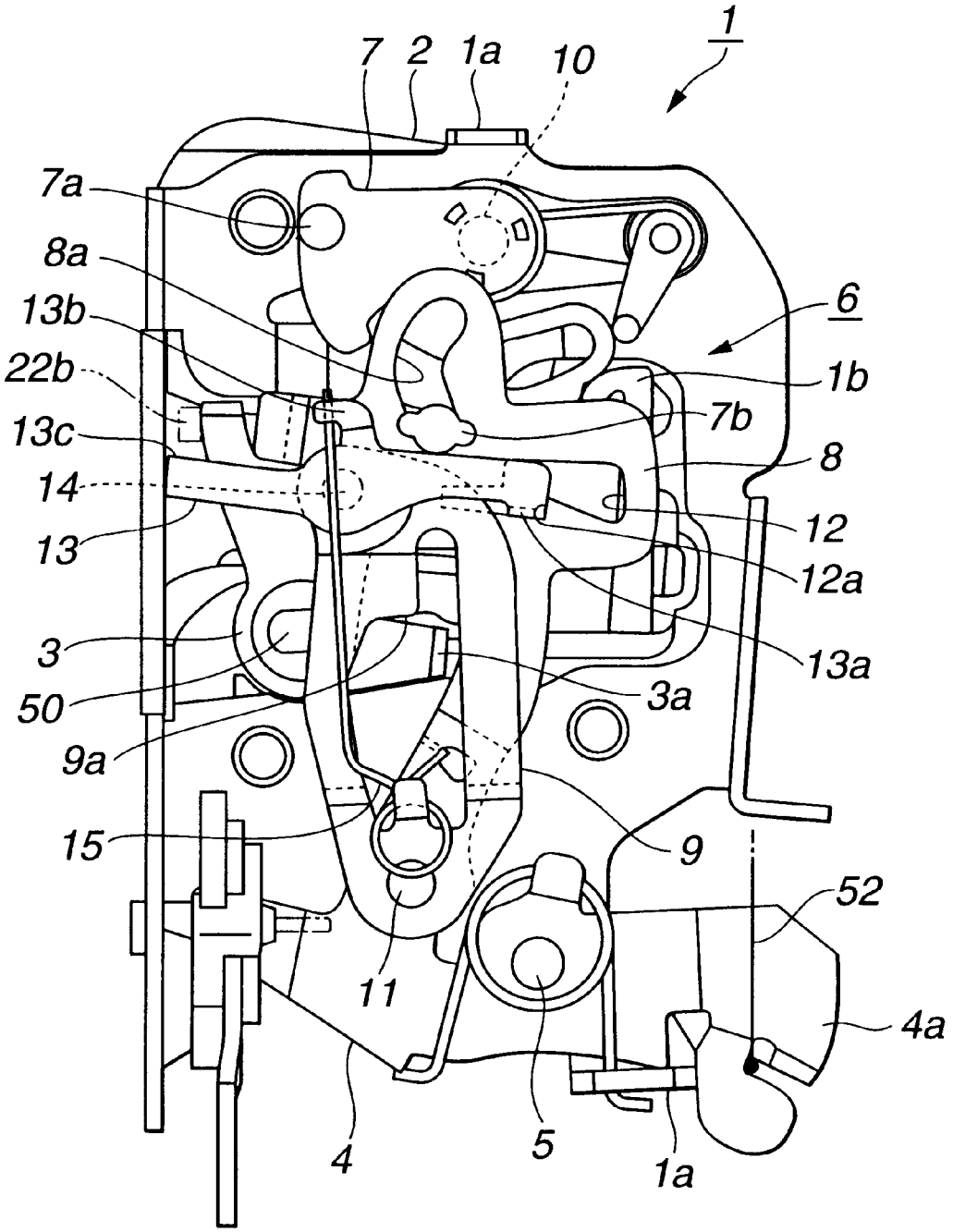
FIG. 1 is a front view of a door lock device of the automotive door lock assembly of the present invention.

As is seen from FIG. 1, the door lock device 1 comprises a case 2 which is to be secured to a side panel of an automotive door by means of bolts (not shown). Within the case 2, there are pivotally installed a latch plate (not shown) that is engageable with a striker fixed to a body of the vehicle, and a lock pawl (not shown) that is engageable with the latch plate to retain or lock the same at a door lock position. Denoted by numeral 50 is a pivot shaft of the lock pawl.

Extending from the pivot shaft 50 is an open lever 3 which pivots together with the pivot shaft 50. That is, when the open lever 3 is pivoted in a clockwise direction in FIG. 1, engagement of the lock pawl with the latch plate becomes cancelled to permit opening of the door.

Denoted by numeral 4 is an outside lever which is pivotally connected to the case 2 through a pivot shaft 5. From an outside end 4*a* of the outside lever 4, there extends a cable 52 to an outside handle (not shown) operatively mounted to the outer panel of the door. That is, when the outside handle is manipulated, the outside lever 4 is pivoted in a counterclockwise direction in FIG. 1, that is, in a door opening direction.

Denoted by numeral 6 is a lock/unlock mechanism installed in the door lock device 1.

As is well seen from FIG. 2, the lock/unlock mechanism 6 comprises generally a first lock/unlock lever 7 which is connected to an operation lever 20 of the electric actuator 16 as will be described in detail hereinafter, a second lock/unlock lever 8 which is arranged between the outside lever 4 and the first lock/unlock lever 7 and a sub-lever 9 which is connected to the second lock/unlock lever 8.

The first lock/unlock lever 7 is pivotally connected to the case 2 through a pivot shaft 10 and has at a free end a connecting portion 7*a* which is connected to the operation lever 20 of the electric actuator 16.

The second lock/unlock lever 8 has a lower portion which is pivotally connected to the outside lever 4 through a pivot shaft 11 and an upper portion which has an arcuate slot 8*a* generally vertically extending. The arcuate slot 8*a* slidably receives therein a projection 7*b* provided on a lower end of the first lock/unlock lever 7. The second lock/unlock lever 8 further has at an intermediate portion a laterally extending slot 12. As well shown in FIG. 2, the slot 12 is formed with a stopper portion 12*a* for the purpose which will become apparent as the description proceeds.

Figure 7:
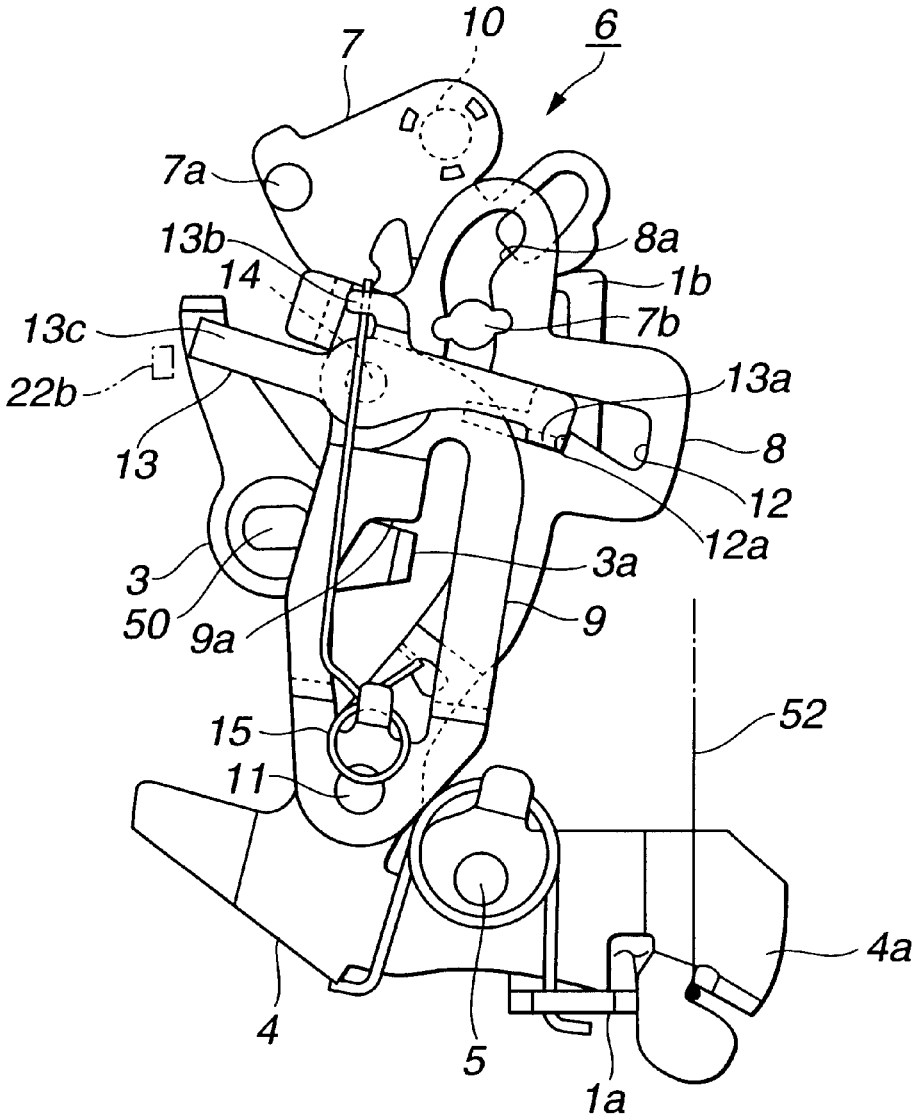
FIG. 7 is a view similar to FIG. 6, but showing a condition wherein the lock/unlock mechanism assumes the unlock condition.

In response to movement of the operation lever 20 of the electric actuator 16, each of the first and second lock/unlock levers 7 and 8 is pivoted between a lock position as shown in FIG. 1 and an unlock position as shown in FIG. 7.

The sub-lever 9 is pivotally connected at its lower portion to the second lock/unlock lever 8 through the pivot shaft 11. As is seen from FIG. 2, the sub-lever 9 is formed at an intermediate portion with a disengaging part 9*a* which is engageable with an engaging portion 3*a* of the open lever 3.

Denoted by numeral 13 is a passive lever which is pivotally connected at an intermediate portion thereof to an upper end of the sub-lever 9 through a pivot shaft 14. A right end of the passive lever 13 is formed with an engaging part 13*a*. The passive lever 13 is pivoted between an engaged position where, as is seen from FIG. 1, the engaging part 13*a* is engaged with the stopper portion 12*a* of the second lock/unlock lever 8 and a disengaged position where, as is seen from FIG. 2, the engaging part 13*a* is disengaged from the stopper portion 12*a*.

Denoted by numeral 15 is a return spring which serves as a biasing means. The return spring 15 has a shorter leg engaged with the second lock/unlock lever 8 and a longer leg engaged with a pawl portion 13*b* of the of the passive lever 13, so that the passive lever 13 is biased in an engaging direction, that is, in a clockwise direction in FIG. 1 and the sub-lever 9 is biased in an unlocking direction relative to the second lock/unlock lever 8, that is, in a clockwise direction in FIG. 1.

When the passive lever 13 is in the engaged position, the movement in an unlock direction relative to the second lock/unlock lever 8 is obstructed, and thus the sub-lever 9 is pivotal together with the second lock/unlock lever 8 between a lock position as shown in FIG. 1 and an unlock position as shown in FIG. 7. While, when the passive lever 13 is pivoted to assume the disengaged position, the sub-lever 9 can be pivoted to unlock position as shown in FIG. 3 due to the force of the return spring 15 even when the second lock/unlock lever 8 is in the lock position or between the lock and unlock positions.

Figure 3:
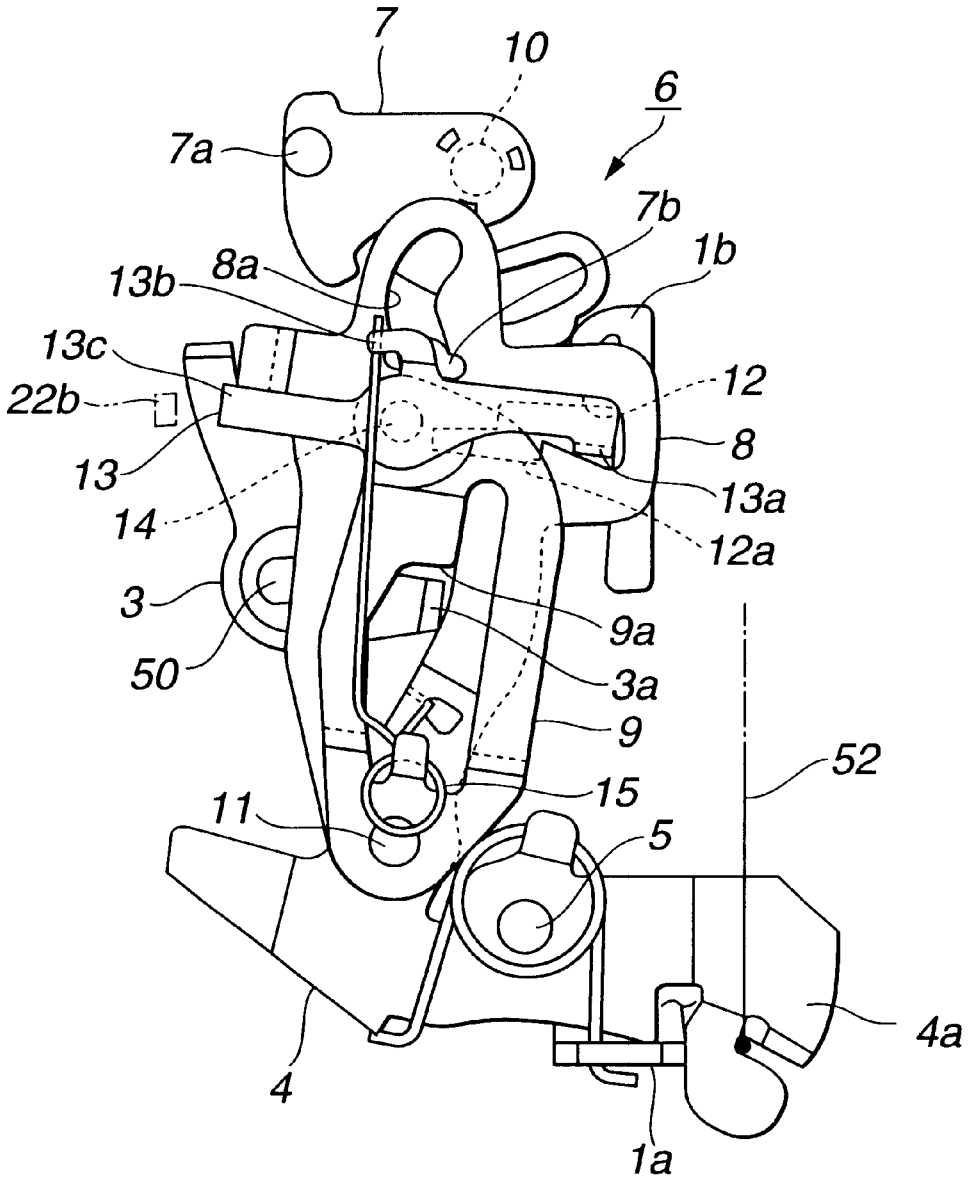
FIG. 3 is a view similar to FIG. 2, but showing a condition wherein a lock/unlock mechanism assumes a temporary unlock condition.

The lock/unlock mechanism 6 can take three conditions, which are an unlock condition wherein as shown in FIG. 7, all of the first and second lock/unlock levers 7 and 8 and sub-lever 9 assume their unlock positions, a lock condition wherein as is shown in FIG. 1, all of the first and second lock/unlock levers 7 and 8 and sub-lever 9 assume their lock positions, and a temporary unlock condition wherein as is shown in FIG. 3, each of the first and second lock/unlock levers 7 and 8 assumes the lock position or an intermediate position between the lock and unlock positions and the sub-lever 9 assumes the unlock position.

When, due to manipulation of the outside handle, the outside lever 4 is pivoted in the opening direction, that is, counterclockwise in FIG. 1, the second lock/unlock lever 8 and the sub-lever 9 are moved downward. With this, the disengaging part 9*a* of the sub-lever 9 is brought into engagement with the engaging portion 3*a* of the open lever 3 causing the open lever 3 to pivot in the door opening direction permitting opening of the door.

However, when the lock/unlock mechanism 6 assumes the lock condition, manipulation of the outside handle can not induce opening of the door. That is, under such condition, even when the second lock/unlock lever 8 and the sub-lever 9 are moved downward due to manipulation of the outside handle, the disengaging part 9*a* of the sub-lever 9 is not brought into engagement with the engaging portion 3*a* of the open lever 3. Thus, the open lever 3 is not pivoted in the door opening direction.

When the lock/unlock mechanism 6 assumes the temporary unlock condition, manipulation of the outside handle can induce opening of the door. That is, under such condition, when the outside handle is manipulated, the sub-lever 9 assuming the unlock position is moved downward through the outside lever 4. With this, the disengaging part 9*a* of the sub-lever 9 is brought into engagement with the engaging portion 3*a* of the open lever 3 causing the open lever 3 to pivot in the door opening direction.

Figure 9:
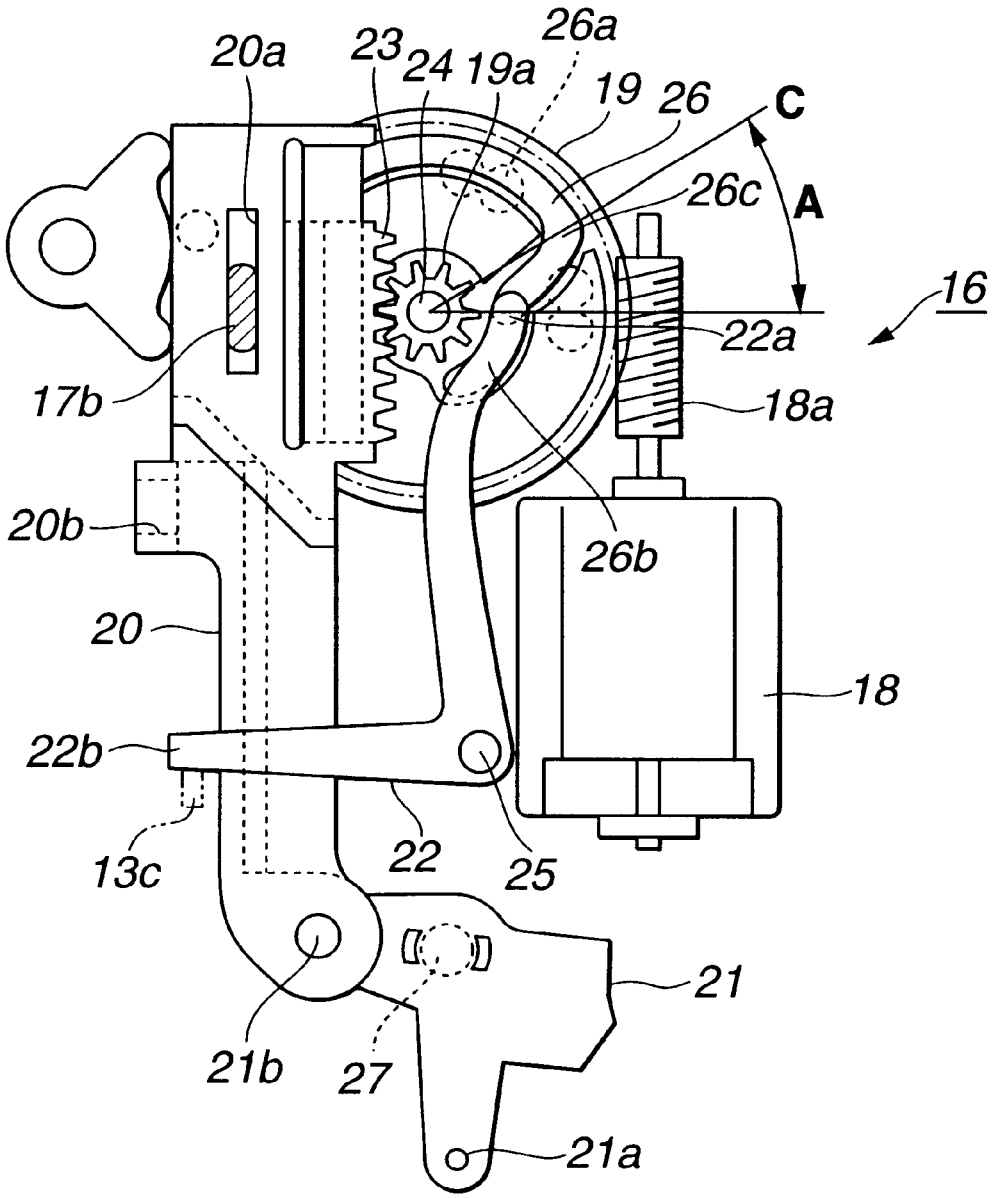
FIG. 9 is a side view of the electric actuator, showing a condition wherein a cancel lever has moved to an operative position and an operation lever is on the way to an unlock position.

As is seen from FIGS. 8 and 9, the electric actuator 16 comprises a plastic housing 17 mounted to the above-mentioned door lock device 1. Within the housing 17, there are installed an electric motor 18 having a worm 18*a* fixed to an output shaft thereof, a worm wheel 19 meshed with the worm 18*a,* the above-mentioned operation lever 20 connected to the above-mentioned first lock/unlock lever 7, a knob lever 21 actuated by a lock knob (not shown) mounted on an inside surface of the door, and a cancel lever 22 serving to move the passive lever 13 from the engaged position to the disengaged position.

As shown in FIG. 8, the electric motor 18 is controlled by a control unit 60 which receives information signals from a handle switch 62 and a signal receiver 64. The handle switch 62 can sense manipulation of the outside handle of the door. The signal receiver 64 can receive a signal issued from a signal transmitter 66 which is held by the driver. That is, when the handle switch 62 senses manipulation of the outside handle by the driver (viz., signal transmitter holder) and the signal receiver 64 receives a given signal from the signal transmitter 66, the control unit 60 issues an instruction signal to the electric motor 18 to rotate the same in a direction to cancel the locked condition of the door lock device 1.

As is seen from FIG. 8, the door lock device 1 is formed with a plurality of catching pawls 1*a* for holding the housing 17 of the electric actuator 16. Upon holding, the various levers of the door lock device 1 are concealed by the housing 17, as is seen from FIG. 11. Within the housing 17, there are further installed various parts of the electric actuator 16. As is seen from FIG. 11, an upper half of the housing 17 is covered by a cover 17*a* for protecting the interior of the housing 17 from water drop and picking tools.

Referring back to FIG. 8, the operation lever 20 has a vertically extending elongate slot 20*a* with which a projection 17*b* of the housing 17 is slidably engaged. Thus, the operation lever 20 is vertically movable relative to the housing 17. The operation lever 20 has further at an intermediate portion a connecting opening 20*b* to which the connecting portion 7*a* of the first lock/unlock lever 7 is connected. It is be noted that when the housing 17 of the electric actuator 16 is mounted on the door lock device 1, the connecting portion 7*a* is automatically engaged with the connecting opening 20*b*.

Figure 10:
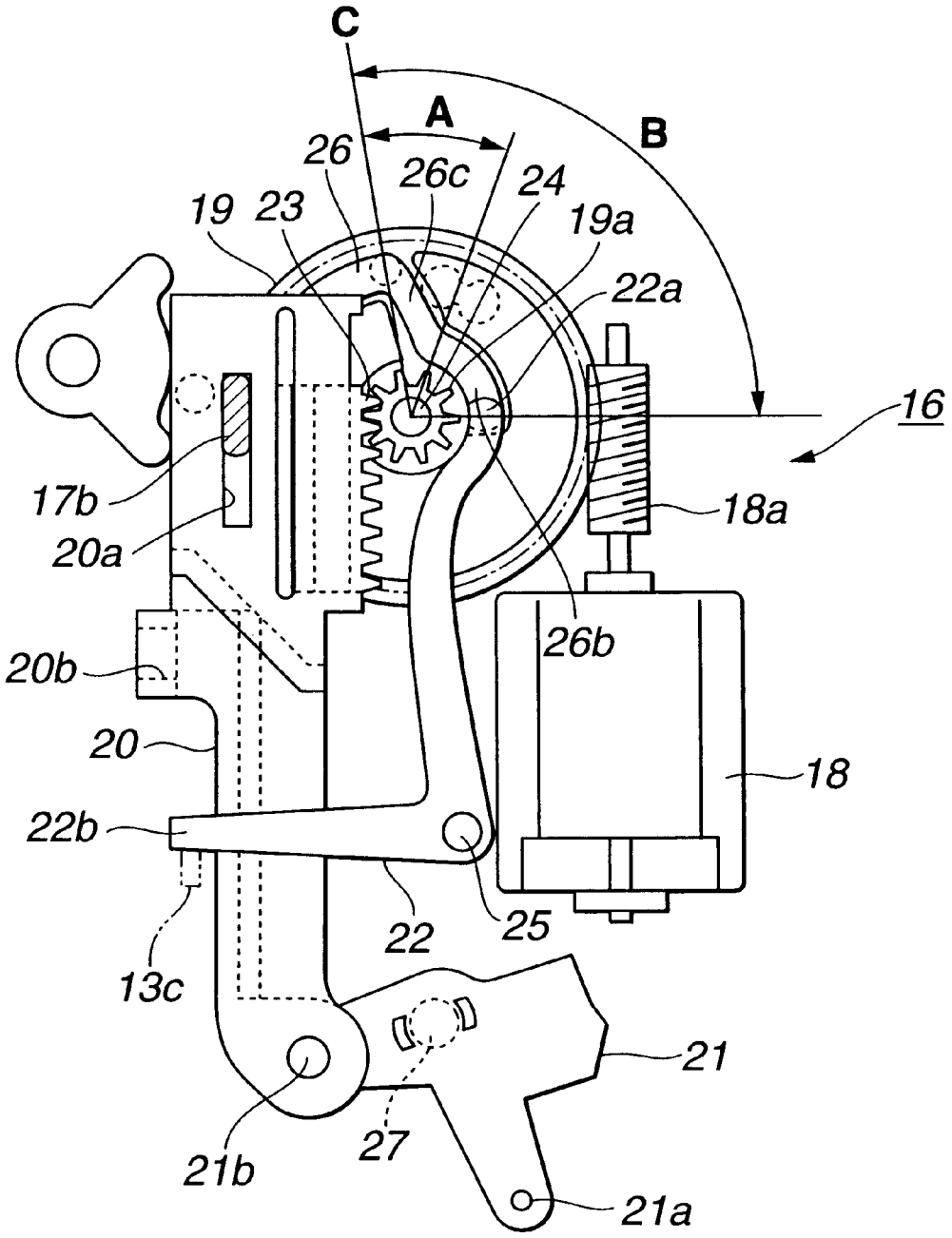
FIG. 10 is a view similar to FIG. 9, showing a condition wherein the cancel lever assumes the operative position and the operation lever has moved to the unlock position.

The operation lever 20 is provided at an upper portion thereof with a rack 23 which is meshed with a pinion 19*a*. The pinion 19*a* is concentrically connected to the worm wheel 19. Thus, upon energization of the electric motor 18, the operation lever 20 is moved vertically due to power transmission from the motor 18 thereto through the worm 18*a,* the worm wheel 19, the pinion 19*a* and the rack 23. That is, the operation lever 20 is moved between a lock position as shown in FIG. 8 to the lock/unlock mechanism 6 and an unlock position as shown in FIG. 10 to unlock the lock/unlock mechanism 6.

It is to be noted that the rack 23 is vertically slidably mounted to the operation lever 20 so that the rack 23 can make a play relative to the operation lever 20 which corresponds to the operation stroke of the operation lever 20 between the lock and unlock positions.

The worm wheel 19 is rotatably held by the housing 17 through a shaft 24 on which the pinion 19*a* is tightly and concentrically disposed. Although not shown in FIG. 8, a spring is applied to the worm wheel 19 to bias the same to its neutral position as shown in FIG. 8. That is, when, due energization of the electric motor 18, the worm wheel 19 is turned from the neutral position in a counterclockwise direction by an angle of "B", the operation lever 20 is moved from the lock position to the unlock position. When thereafter the electric motor 18 is deenergized, the worm wheel 19 is turned back to the neutral position due to force of the spring.

The cancel lever 22 is generally L-shaped including longer and shorter arms. The cancel lever 22 is pivotally connected at a junction part of the two arms to the housing 17 through a pivot shaft 25. The longer arm of the cancel lever 22 has at its leading end a projection 22*a* which is slidably engaged with a cam groove 26 formed in a side surface of the worm wheel 19. The shorter arm of the cancel lever 22 has at its leading end a canceling part 22*b* which is engageable with an engaging portion 13*c* of the above-mentioned passive lever 13.

The cam groove 26 comprises an outer arcuate part 26*a* which extends in a counterclockwise direction from a middle position "C" shown in FIG. 8, an inner arcuate part 26*b* which extends in a clockwise direction from the middle position "C" and a connecting part 26*c* which connects the outer and inner arcuate parts 26*a* and 26*b*. As shown, the inner arcuate part 26*b* is positioned closer to the shaft 24 of the worm wheel 19 than the outer arcuate part 26*a*.

When the worm wheel 19 assumes the neutral position as shown in FIG. 8, the projection 22*a* of the longer arm of the cancel lever 22 is engaged with the outer arcuate part 26*a* to cause the cancel lever 22 to assume an inoperative position as shown in the drawing. While, when, due to turning of the worm wheel 19, the projection 22*a* is slid from the outer arcuate part 26*a* to the inner arcuate part 26*b* through the connecting part 26*c*, the cancel lever 22 is instantly pivoted to an operative position from the inoperative position.

That is, due to rotation of the worm wheel 19, the cancel lever 22 is moved to the operative position first, and then, the operation lever 20 is moved to the unlock position.

The knob lever 21 is pivotally connected to the housing 17 through a pivot shaft 27. The knob lever 21 has a left end pivotally connected to a lower portion of the operation lever 20 through a pivot pin 21*b*. The knob lever 21 has at its lower end an opening 21*a* to which a cable 28 (see FIG. 11) from the lock knob on the door is connected. That is, due do manipulation of the lock knob, the knob lever 21 is pivoted thereby to move the operation lever 20 between the lock and unlock positions.

In the following, operation of the automotive door lock assembly 100 of the present invention will be described with reference to the drawings.

For ease of understanding, the description will be commenced with respect to a closed and locked condition of the door relative to the vehicle body. Under this condition, the latch plate of the door lock device 1 fully catches the striker and the lock pawl locks the latch plate. More specifically, the parts of the door lock device 1 assume the conditions as shown in FIG. 1, and the parts of the electric actuator 16 assumes the conditions as shown in FIG. 8.

When now, for getting into the vehicle cabin, a driver carrying the signal transmitter 66 comes to the vehicle door and handles the outside handle of the door, the signal receiver 64 and the handle switch 62 provide the control unit 60 with information signals. Upon receiving these signals, the control unit 60 issues an instruction signal to the electric motor 18 to rotate the same in a direction to cancel the locked condition of the door lock device 1.

With this, the worm wheel 19 is turned in a counterclockwise direction from the neutral position of FIG. 8 by an angle of "A" to a position as shown in FIG. 9. During this, the operation lever 20 is moved by the pinion 19*a* from the lock position of FIG. 8 toward the unlock position as is seen from FIG. 9. Furthermore, during this, the projection 22*a* of the cancel lever 22 slides from the outer arcuate part 26*a* of the cam groove 26 to the connecting part 26*c* of the same. Thus, as is seen from FIG. 9, the cancel lever 22 is pivoted to the operative position from the inoperative position prior to arrival of the operation lever 20 at the unlock position.

Figure 2:
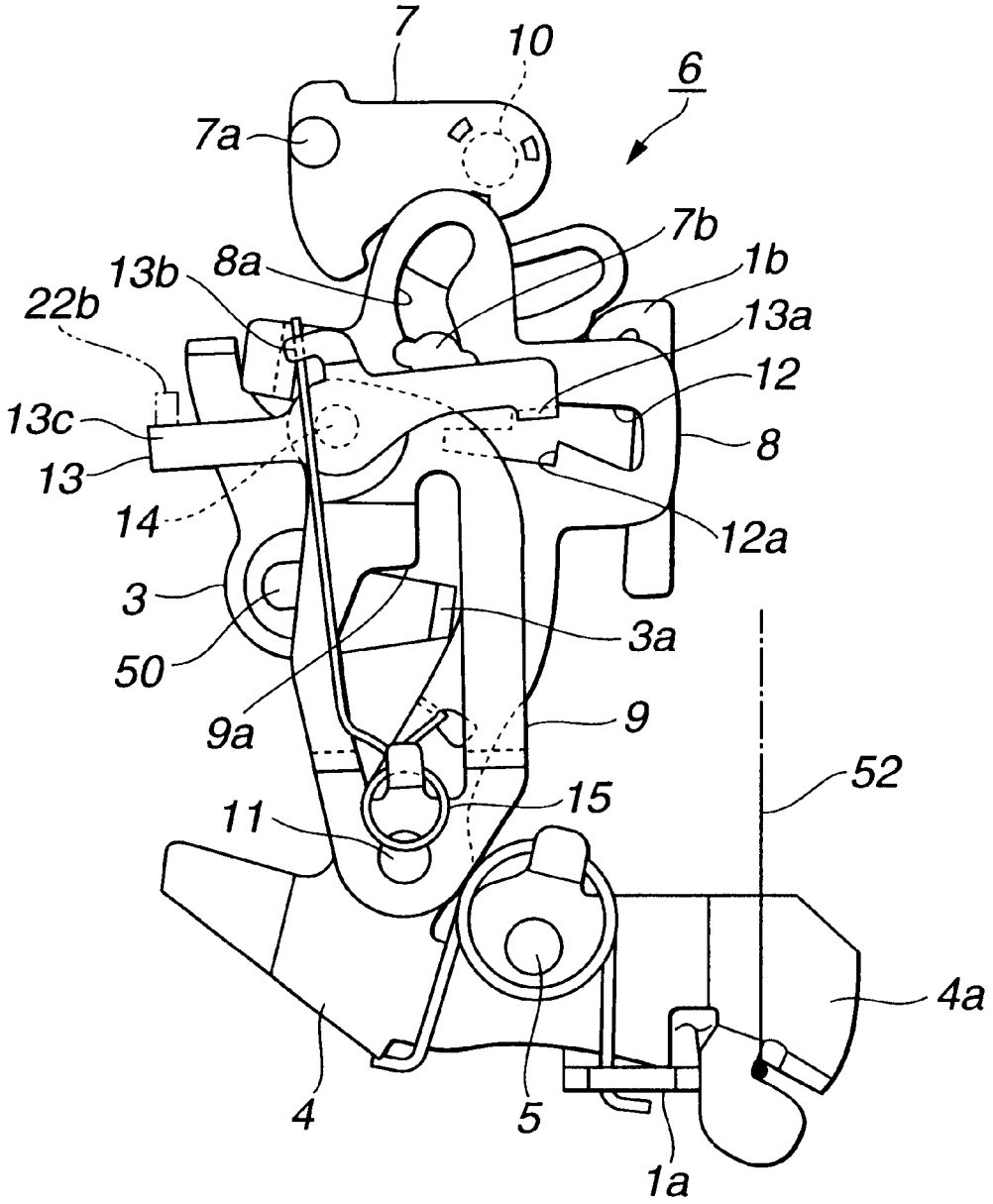
FIG. 2 is a front view of the door lock device, showing a condition wherein a passive lever has moved to an unlock position.

Thus, the canceling part 22*b* of the cancel lever 22 becomes in contact with the engaging portion 13*c* of the passive lever 13 and pivots the lever 13 from the engaged position to the disengaged position of FIG. 2 against the force of the return spring 15.

As a result of this action, the engagement between the second lock/unlock lever 8 and the sub-lever 9 becomes cancelled, so that by the force of the return spring 15, the sub-lever lever 9 is instantly moved to the temporary unlock position of FIG. 3 and stopped at the lock position because the right end of the passive lever 13 abuts on a stopper 1*b*.

Thus, during the time for which each of the first and second lock/unlock levers 7 and 8 pivots from the lock position of FIG. 1 to the unlock position of FIG. 7, the lock/unlock mechanism 6 can be instantly brought to the temporary unlock condition. Although, upon this, the mutual abutment between the engaging portion 13*c* of the passive lever 13 and the canceling part 22*b* of the cancel lever 22 becomes canceled, the passive lever 13 is permitted to stay at the disengaged position because the engaging part 13*a* of the passive lever 13 contacts a lower end of the laterally extending slot 12 of the lever second lock/unlock lever 8.

Figure 4:
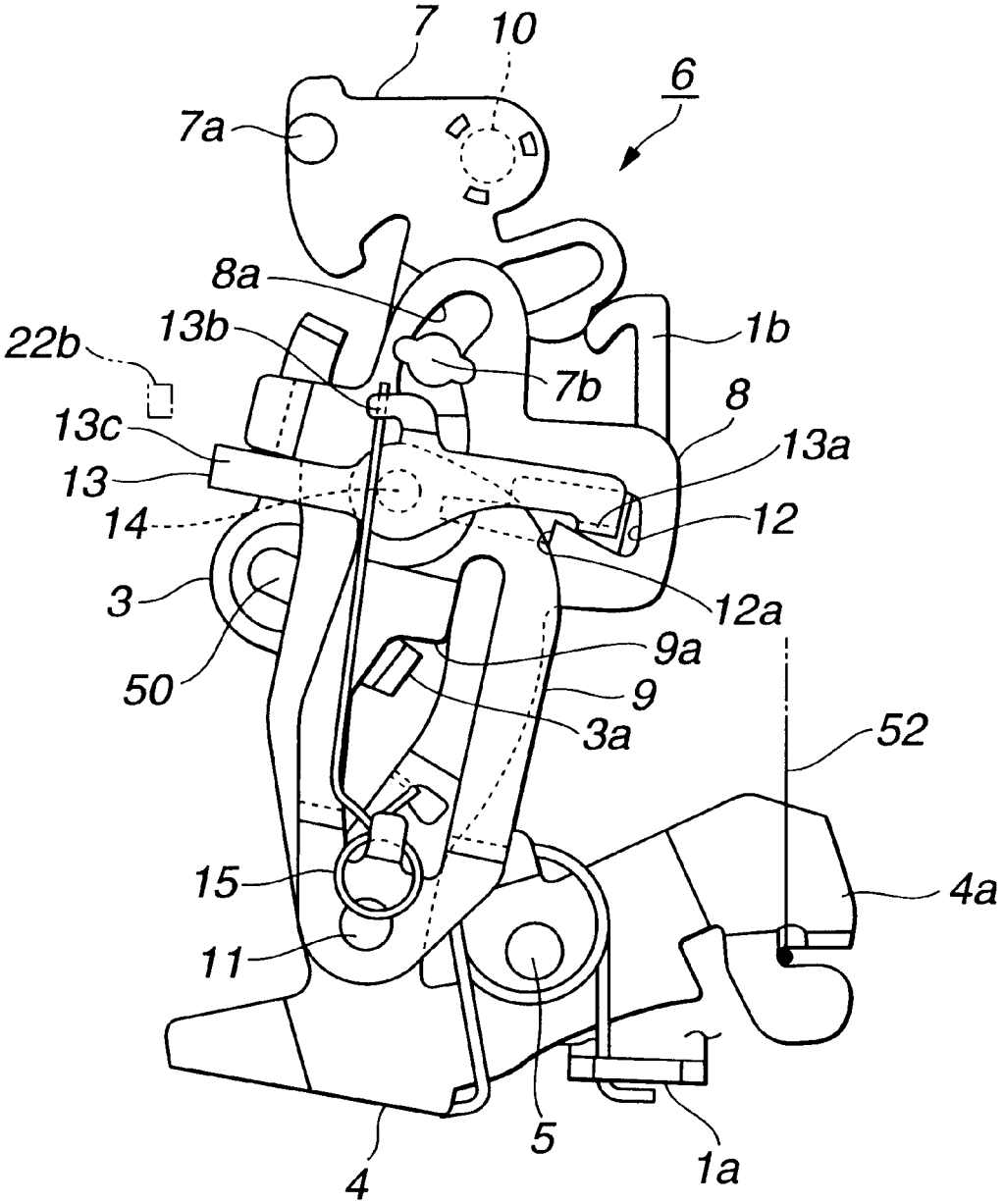
FIG. 4 is a view similar to FIG. 3, but showing a condition wherein, with the lock/unlock mechanism assuming the temporary unlock condition, an outside door handle is manipulated.

When, now, due to manipulation of the outside handle by the driver, the outside lever 4 is pivoted in the door opening direction, the disengaging part 9*a* of the sub-lever 9 becomes engaged with the engaging portion 3*a* of the open lever 3 as is shown in FIG. 4 thereby pivoting the open lever 3 in the door opening direction. With this, the lock pawl integrally connected to the open lever 3 releases the latch plate. Thus, the door can be opened.

When, thereafter, due to continuous turning, the worm wheel 19 is brought to a position of FIG. 10 that is far from the neutral position by an angle of "B", the projection 22*a* of the cancel lever 22 is slid from the connecting part 26*c* of the cam groove 26 to the inner arcuate part 26*b* of the same. With this, the cancel lever 22 is kept in the operative position and the operation lever 20 is moved to the unlock position.

Figure 5:
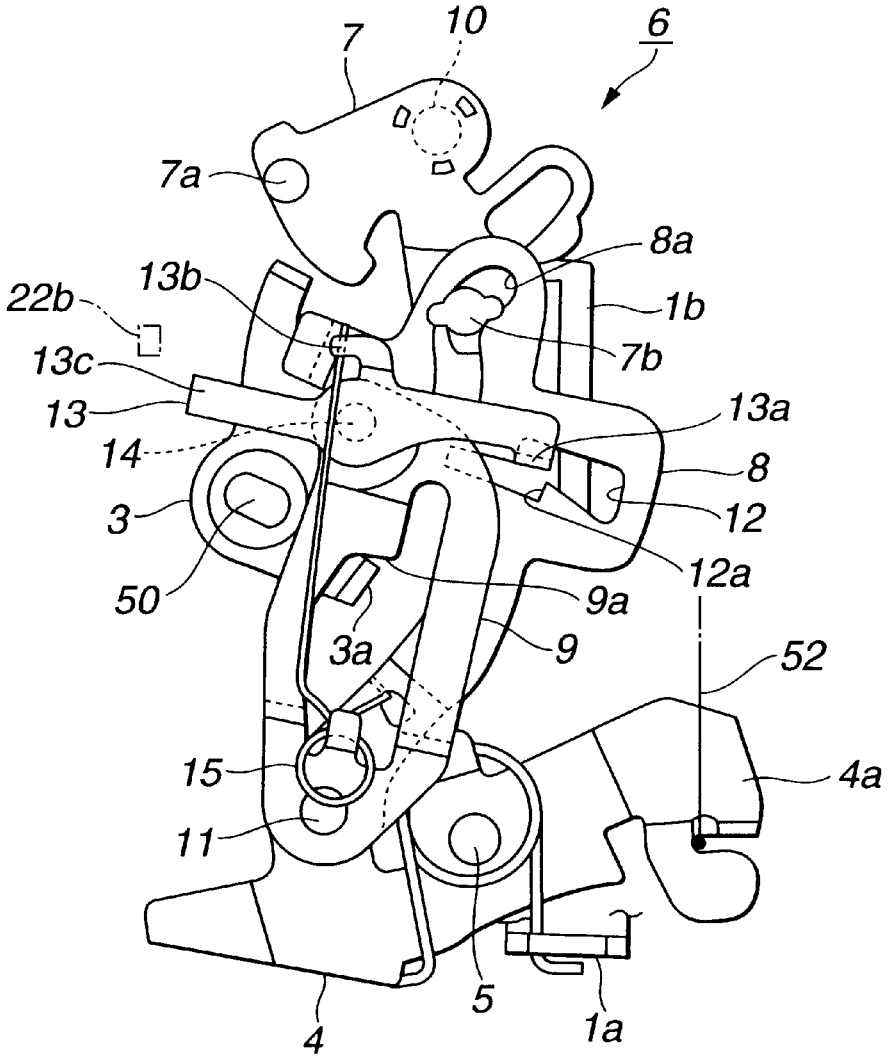
FIG. 5 is a view similar to FIG. 4, but showing a condition wherein, with the lock/unlock mechanism assuming the temporary unlock condition, a lock/unlock lever has moved to an unlock position.

Accordingly, the first and second lock/unlock levers 7 and 8 are each pivoted toward the unlock position and as is shown in FIG. 5, the engaging part 13*a* of the passive lever 13 comes to a position engageable with the stopper portion 12*a* of the second lock/unlock lever 8.

Figure 6:
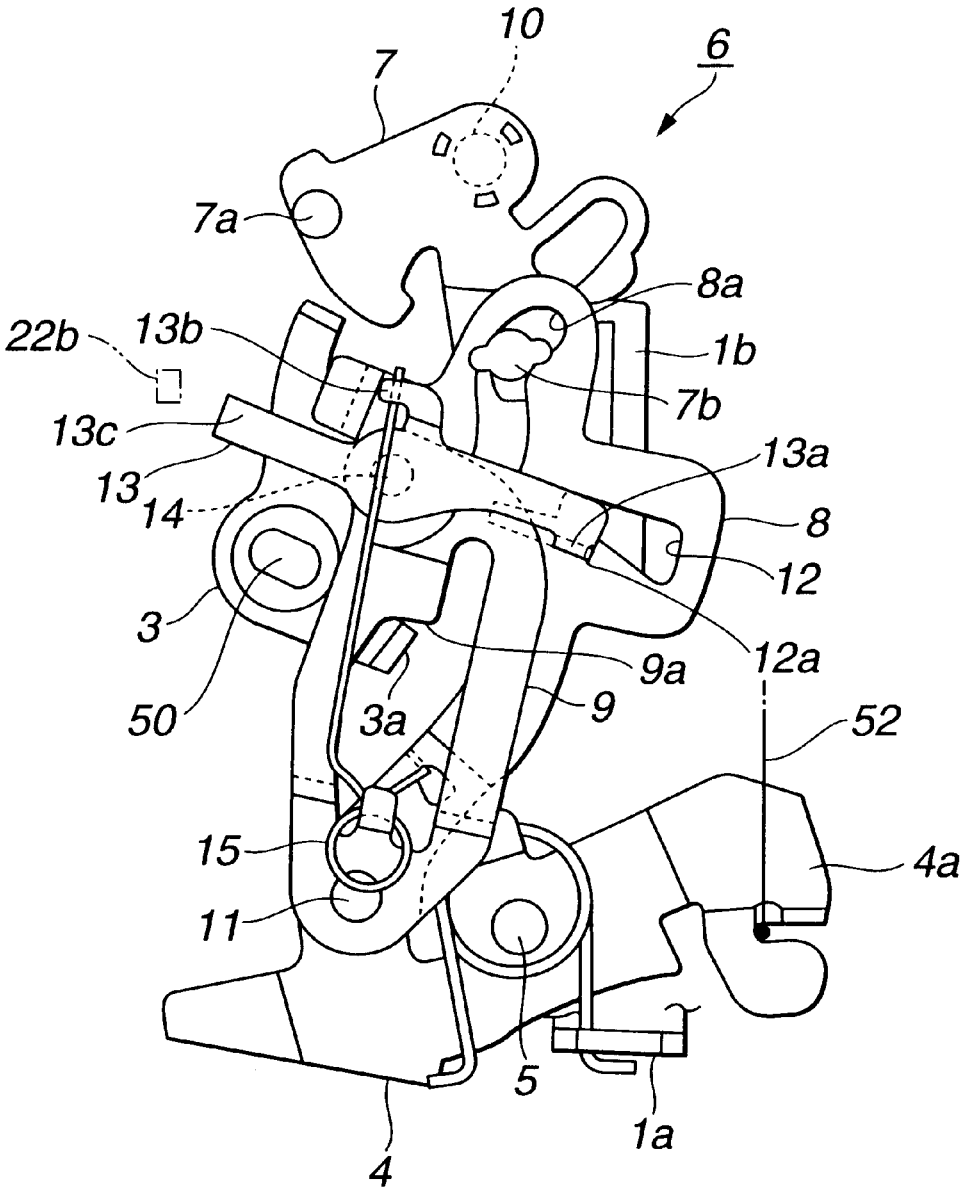
FIG. 6 is a view similar to FIG. 5, but showing a condition wherein the lock/unlock mechanism is about to switch from the temporary unlock condition to an unlock condition.

Thus, due to the force of the return spring 15, the passive lever 13 is moved to the engaged position as shown in FIG. 6.

When thereafter the outside handle of the door is released from the driver's hand, the lock/unlock mechanism 6 takes the unlock condition of FIG. 7, and the worm wheel 19 is returned to the neutral position and the cancel lever 22 is returned to the inoperative position.

The following modification may be used. That is, in the above-mentioned embodiment, the passive lever 13 is connected to the sub-lever 9 and the stopper portion 12*a* is provided to the second lock/unlock lever 8. However, if desired, the passive lever 13 may be connected to the second lock/unlock lever 8 and the stopper portion 12*a* may be provided to the sub-lever 9.

In the following, advantages of the present invention will be described.

First, at an initial stage of the unlocking operation of the electric actuator 16, the passive lever 13 is permitted to move to the disengaged position. Thus, prior to movement of the first and second lock/unlock levers 7 and 8 to the unlock positions from the lock positions by the electric actuator 16, the sub-lever 9 can be shifted to the unlock position by the return spring 15. Accordingly, the lock/unlock mechanism 6 can be quickly shifted from its door lock condition to a door release condition wherein manipulation of the outside handle of the door brings about opening of the door.

Second, shifting of the sub-lever 9 to the unlock position is easily achieved with a relatively small force by the movement of the passive lever 13 from the engaged position to the disengaged position. Accordingly, only a lower power type is needed for the electric motor 18 of the electric actuator 16. Thus, reduction in cost and reduction in size of the door lock assembly are achieved.

The entire contents of Japanese Patent Application 2000-330891 (filed Oct. 30, 2000) are incorporated herein by reference.

Although the invention has been described above with reference to the embodiment of the invention, the invention is not limited to such embodiment as described hereinabove. Various modifications and variations of such embodiment may be carried out by those skilled in the art, in light of the above descriptions.

What is claimed is:

1. An automotive door lock assembly comprising:

a lock/unlock mechanism including a lock/unlock lever and a sub-lever, said lock/unlock mechanism being able to switch between a lock condition wherein both the lock/unlock lever and sub-lever assume respective lock positions to induce a locked condition of the door and an unlock condition wherein both the lock/unlock lever and sub-lever assume respective unlock positions to induce an unlocked condition of the door;

an electric actuator which forces said lock/unlock mechanism to switch between said lock and unlock conditions with an electric force; and a structure including a passive lever and a biasing means which are incorporated with said door lock assembly, said passive lever being actuated by said electric actuator and shifted, at an initial stage of the operation of said electric actuator for shifting the lock/unlock mechanism to said unlock condition, from an engaged position where said lock/unlock lever and said sub-lever are engaged to move together to a disengaged position where the engagement between said lock/unlock lever and said sub-lever is canceled, wherein when said passive lever is shifted to said disengaged position, said sub-lever is shifted to said unlock position by said biasing means prior to shifting of said lock/unlock lever to said unlock position from said lock position by said electric actuator.

2. An automotive door lock assembly as claimed in claim 1, in which said biasing means of said structure comprises a spring which has one end engaged with said lock/unlock lever and the other end engaged with said sub-lever.

3. An automotive door lock assembly as claimed in claim 1, in which said passive lever is pivotally connected to said sub-lever, and in which said biasing means comprises a spring for biasing said passive lever toward said engaged position, said spring having one end engaged with said lock/unlock lever and the other end engaged with said passive lever.

4. An automotive door lock assembly comprising:

a lock/unlock mechanism including a lock/unlock lever and a sub-lever which are each movable between lock and unlock positions, said lock/unlock mechanism being able to switch between a lock condition wherein both the lock/unlock lever and sub-lever assume respective lock positions to induce a locked condition of the door, an unlock condition wherein both the lock/unlock lever and sub-lever assume respective unlock positions to induce an unlocked condition of the door and a temporary unlocked condition wherein said lock/unlock lever assumes said lock position or a position between said lock and unlock positions and said sub-lever assumes the unlock position to induce an unlocked condition of the door;

a passive lever movably connected to one of said lock/unlock lever and said sub-lever, said passive lever being movable between an engaged position where said passive lever engages with a stopper portion provided on the other of said lock/unlock lever and said sub-lever thereby to engage said lock/unlock lever with said sub-lever and a disengaged position where said passive lever disengages from said stopper portion thereby to permit said lock/unlock mechanism to switch from said lock condition to said temporary unlocked condition;

biasing means which biases said sub-lever toward said unlock position with respect to said lock/unlock lever;

an electric actuator;

an operation lever which is moved by said electric actuator between a lock position to induce the lock condition of said lock/unlock mechanism and an unlock position to induce the unlock condition of said lock/unlock mechanism; and a cancel lever moved by said electric actuator, said cancel lever being capable of shifting said passive lever to said disengaged position from said engaged position prior to the movement of said operation lever to said unlock position from said lock position.

5. An automotive door lock assembly as claimed in claim 4, in which said biasing means comprises a spring which has one end engaged with said lock/unlock lever and the other end engaged with said sub-lever.

6. An automotive door lock assembly as claimed in claim 4, in which said passive lever is pivotally connected to said sub-lever, and in which said biasing means comprises a spring for biasing said passive lever toward said engaged position, said spring having one end engaged with said lock/unlock lever and the other end engaged with said passive lever.

7. An automotive door lock assembly as claimed in claim 4, in which said electric actuator comprises an electric motor, a wheel member driven by said motor and a link mechanism which moves said operation lever and said passive lever when said wheel member rotates, said link mechanism shifting said operation lever to said unlock position from said lock position when said wheel member rotates by a given angle, and said link mechanism shifting said cancel lever to an operative position to shift the passive lever to said disengaged position from said engaged position when said wheel member rotates by an angle that is smaller than said given angle.

8. An automotive door lock assembly as claimed in claim 7, in which said wheel member is a gear which is provided at its center with a pinion, said pinion being meshed with a rack mounted on said operation lever, and in which said cancel lever has one end slidably engaged with a cam groove formed in one side of said gear.

* * * * *